US005625960A

United States Patent [19]

Fujita

[11] Patent Number: 5,625,960

[45] Date of Patent: May 6, 1997

[54] UNIT FOR REMOVING RAINWATER FROM UMBRELLAS

[76] Inventor: Sanai Fujita, 107 Green Park Kotesashi, 12-1, 4-chome, Kotesashi-cho, Tokorozawa-shi, Saitama-ken, Japan

[21] Appl. No.: 342,703

[22] Filed: Nov. 21, 1994

[30] Foreign Application Priority Data

| | | | |
|---|---|---|---|
| Jun. 21, 1994 | [JP] | Japan | 6-160723 |
| Jun. 21, 1994 | [JP] | Japan | 6-160725 |
| Jul. 11, 1994 | [JP] | Japan | 6-009370 U |

[51] Int. Cl.[6] ..... F26B 9/00

[52] U.S. Cl. ..... 34/80; 34/95; 34/202; 135/34.2; 211/62

[58] Field of Search ..... 34/202, 107, 218, 34/80, 81, 95; 211/62; 135/34.2

[56] References Cited

U.S. PATENT DOCUMENTS

| | | | |
|---|---|---|---|
| 1,712,022 | 5/1929 | Berg | 34/107 |
| 5,261,541 | 11/1993 | Li | 211/62 |

FOREIGN PATENT DOCUMENTS

| | | | |
|---|---|---|---|
| 2357873 | 9/1974 | Germany | 34/202 |
| 4-139376 | 5/1992 | Japan . | |
| 4-203882 | 7/1992 | Japan . | |
| 4-217778 | 8/1992 | Japan . | |
| 6-42865 | 2/1994 | Japan . | |
| 6-42864 | 2/1994 | Japan . | |
| 6-109362 | 4/1994 | Japan . | |
| 6-213565 | 8/1994 | Japan . | |
| 229819 | 11/1943 | Switzerland | 34/202 |

*Primary Examiner*—James Larson
*Attorney, Agent, or Firm*—Andrus, Sceales, Starke & Sawall

[57] ABSTRACT

Disclosed is a unit, for removing rainwater from umbrellas, that can easily, effectively, and quickly remove rainwater from umbrellas. This unit comprises an umbrella insertion portion into which an umbrella that is wet with rain is inserted, a rainwater collecting portion where rainwater is held and from which it is discharged, and, with some configurations, a fan compartment from which warm air is driven into the umbrella insertion portion. With another configuration, the unit comprises a cylindrical external frame that has a handle and multiple brushes that are provided on the internal wall of the external frame. With these arrangements, the unit according to the present invention can easily, effectively, and quickly remove rainwater from wet umbrellas.

18 Claims, 7 Drawing Sheets

UNIT FOR REMOVING RAINWATER FROM UMBRELLAS

BACKGROUND OF THE INVENTION

1. Field of the Invention

The present invention relates to a unit, for removing rainwater from umbrellas, that can easily and effectively strip water from umbrellas that are wet with rain.

2. Description of the Related Art

Conventionally, to hold the wet umbrellas of their customers on rainy days, at their entrances banks, supermarkets, restaurants, hotels, etc., install umbrella storage racks with key locking devices and moisture collection trays, or provide plastic bags with which wet umbrellas can be covered.

When average homeowners have many guests at their homes for parties, wet umbrellas are stored in umbrella stands by the front doors of their houses or are placed upright at the entrances.

However, since with an umbrella storage rack that has key locking devices it takes time to store an umbrella, especially a folding umbrella, and as people may forget to retrieve their umbrellas from the umbrella rack when they leave, and since plastic bags that are used to cover wet umbrellas may break and water may leak onto the floor, neither of these methods satisfactorily copes with umbrellas that are wet with rain.

Further, when there are many guests at an average home on a rainy day, as there is no fully adequate method by which to handle wet umbrellas, the water that leaks from wet umbrellas onto the floor at the house entrance, and the guests who forget to pick up their umbrellas, or take the wrong umbrellas, when they depart are sources of trouble for the homeowner later.

SUMMARY OF THE INVENTION

To overcome the above described shortcomings, it is an object of the present invention to provide a unit, for removing rainwater from umbrellas, that can easily, effectively, and quickly remove water from umbrellas that are wet with rain.

To achieve this object, in a first embodiment of the present invention is described a unit, for removing rainwater from umbrellas, that comprises an umbrella insertion portion, into which an umbrella wet with rainwater is inserted, and a rainwater collecting portion, for collecting and discharging rainwater.

In a second embodiment of the present invention is described a unit, for removing rainwater from umbrellas, that comprises an umbrella insertion portion, into which an umbrella wet with rainwater is inserted, a rainwater collecting portion, for collecting and discharging rainwater, and a fan compartment from which warm air is driven into the umbrella insertion portion.

In a third embodiment of the present invention is described a unit, for removing rainwater from umbrellas, wherein a plurality of the umbrella insertion portions of the first or the second embodiment are provided in line and a rainwater collecting portion is positioned below the umbrella insertion portions.

In a fourth embodiment of the present invention is described a unit, for removing rainwater from umbrellas, wherein a plurality of the umbrella insertion portions of the first or second embodiment are provided in line and a rainwater collecting portion is positioned below the umbrella insertion portions, and a fan compartment is so located at the base of the umbrella insertion portions that warm air driven from the fan compartment can pass through air outlets and enter the umbrella insertion portions.

In a fifth embodiment of the present invention is described a unit, for removing rainwater from umbrellas, that comprises a cylindrical external frame that has a handle, and multiple brushes that are secured to the internal wall of the external frame.

According to the first and second embodiments of the present invention, the umbrella insertion portion, which has a cylindrical shape, has an umbrella insertion port formed in its top, a first rainwater drain port formed in its bottom, and multiple brushes positioned on its internal wall.

The brushes that are located in the umbrella insertion portion are made of plastic or fiber, or animal hair, and extend inward to the vicinity of the center of the umbrella insertion portion.

The brushes that are located in the umbrella insertion portion are held by brush mounting members, which are attached to the internal wall of the external frame of the umbrella insertion portion.

In the first and second embodiments, as modified, the umbrella insertion portion, which has a cylindrical shape, has an umbrella insertion port formed in its top, a first rainwater drain port formed in its bottom, and a plurality of brush members along which multiple brushes are arranged. There are three brush members, a first, a second, and a third.

The multiple brushes that are located along the brush members are made of plastic or fiber, or animal hair, and extend inward to the vicinity of the center of the umbrella insertion portion.

The first, second, and third brush members rotate and vibrate when an umbrella is inserted into or retrieved from the umbrella insertion portion.

The ends of the multiple brushes, which are held by the brush members in the umbrella insertion portion, are embedded in the brush mounting members, which are attached to the external walls of the brush members.

In the fan compartment of the second embodiment, the warm air outlet is positioned on the side of the umbrella insertion portion. Besides a heater and a fan that are mounted in the fan compartment, an alkaline ceramic body 10 is located between the heater and the outlet.

The temperature of the warm air that is driven from the fan compartment into the umbrella insertion portion is approximately 20° C. to 40°C.

The alkaline ceramic body in the second embodiment includes at least one element that is selected from a group consisting of powdered animal bone, powdered shells, powdered limestone, silica, and powdered coral.

The shape of the alkaline ceramic body is columnar, and it has a plurality of longitudinal through holes in its cross section.

The rainwater collecting portion in the first and second embodiments has at its bottom a second rainwater drain port that can be opened and closed as necessary.

According to the third embodiment, a unit for removing rainwater from umbrellas has a plurality of the umbrella insertion portions of the first or the second embodiment arranged in line, and has a rainwater collecting portion positioned below the umbrella insertion portions.

According to the fourth embodiment, a unit for removing rainwater from umbrellas has a plurality of the umbrella insertion portions of the first or the second embodiment arranged in line, a rainwater collecting portion located below the umbrella insertion portions, and a fan compartment that is so positioned that warm air driven from the fan compartment passes through air outlets and enters the umbrella insertion portions.

According to the fifth embodiment, a unit for removing rainwater from umbrellas includes a cylindrical external frame with a handle, and multiple brushes, which are provided on the internal wall of the external frame.

The brushes that are provided on the internal wall of the external frame are made of plastic or fiber, or animal hair, and extend inward to the vicinity of the center of the external frame.

The ends of the brushes are embedded in the brush mounting members, which are attached to the internal wall of the external frame.

The brushes that are provided on the internal wall of the external frame consist of a plurality of brush groups that are tapered as they approach the center.

According to the present invention, when an umbrella that has been wet with rain is closed and inserted, with its handle up, through the umbrella insertion port, multiple brushes provided in the umbrella insertion portion slip into the folds in the canopy material of the umbrella and contact all of the external surface of the folded canopy material.

Thereafter, the umbrella is removed from the umbrella insertion portion. While the umbrella is being extracted, the canopy material in the folds of the umbrella contacts the multiple brushes that are provided in the umbrella insertion portion in the same manner as when the umbrella was inserted therein.

While the umbrella is inserted into, or extracted from, the umbrella insertion portion, rainwater is absorbed by the multiple brushes that contact the umbrella and the water thereon is completely removed.

By vibrating the multiple brushes as the umbrella is extracted from the umbrella insertion portion, rainwater on the brushes is shaken off, falls to the bottom of the umbrella insertion portion, and passes through the first rainwater drain port. When the brushes vibrate as the next umbrella is inserted into the umbrella insertion portion, rainwater is again shaken off the brushes and passes through the first rainwater drain port.

Further, the warm air that is driven from the fan compartment into the umbrella insertion portion dries the multiple brushes that absorb rainwater and also evaporates water that is retained in the umbrella insertion portion. The dried brushes can therefore completely remove the rainwater from the next umbrella that is inserted into the umbrella insertion portion.

Since the alkaline ceramic body is so positioned in the fan compartment that air warmed by the heater and driven by the fan passes through it, the drying of the brushes and the evaporation of water in the umbrella insertion portion are accelerated and the removal of rainwater from an umbrella is ensured.

The rainwater collecting portion can hold a specified volume of rainwater. When there are only a few umbrellas to be dried, the second rainwater drain tap that is formed in the rainwater collecting portion can be kept closed. In this case, as a water storage tank is not absolutely essential, less space is required for the installation of the unit for removing rainwater from umbrellas.

The first, second, and third brush members rotate when an umbrella is inserted into, or extracted from, the umbrella insertion portion, so that brushes that have not absorbed rainwater are shifted toward the center of the umbrella insertion portion, i.e., toward an umbrella when it is inserted, to prepare to process the umbrella that is next inserted. The repetitive rotation of the brush members in this manner enables the brushes to completely remove rainwater from successively inserted umbrellas.

In addition, to remove rainwater from the brushes the first, second, and third brush members vibrate up and down or from side to side when an umbrella is inserted into, or extracted from, the umbrella insertion portion. The repetitive vibration of the brush members enables the brushes to completely remove rainwater from successively inserted umbrellas.

According to the third and fourth embodiments, by providing a plurality of the umbrella insertion portions multiple umbrellas can be processed simultaneously.

Described in the fifth embodiment is a compact and portable unit, for removing rainwater from an umbrella, through which a closed umbrella that is wet with rain is passed while the umbrella handle is held by a user. By slipping into the folds in the canopy material of the umbrella, the multiple brushes provided within the external frame are able to contact all of the exterior surface of the canopy material.

When an umbrella is inserted into, and extracted from this unit, the multiple brushes that come into contact with the canopy material in the folded portions of the umbrella absorb and completely remove any rainwater that is on the umbrella.

Then, by shaking the unit in the fifth embodiment, the moisture absorbed by the multiple brushes can be easily disposed of. This unit can be covered by a plastic bag, or placed in a plastic container, so that it can be carried on a rainy day.

By carrying such a unit, it is possible for a user to avoid the problems that may arise when water on an umbrella leaks onto the clothing of other passengers in, for example, a train or a bus. The user can also avoid other problems that may occur on a visit to an average home: such as dribbling water from a damp umbrella onto floors, picking up the wrong umbrella or forgetting one's own, or becoming involved in a confused situation when a number of guests are getting ready to depart.

Further, at an average home, this unit can be placed by the front door so that it is available for visitors to use. In this case, it will be especially useful for visitors who carry folding umbrellas, for after rainwater has been removed from them by this unit, they can be folded and kept close at hand.

As described above, since the unit of the present invention can easily, effectively, and quickly remove rainwater from umbrellas, and can thus eliminate the possibility that umbrellas will be forgotten or that people will pick up and depart with the wrong ones, supermarkets, restaurants, government offices, and average homes can provide better service on rainy days for their customers and visitors.

Also, by installing units of the present invention near subway ticket gates, etc., so that passengers may use them to dry their umbrellas on rainy days, train passengers can avoid the unpleasantness of having their clothing, or articles they are carrying, dampened.

DETAILED DESCRIPTION OF THE PREFERRED EMBODIMENTS

The preferred embodiments of a unit according to the present invention will now be described while referring to the accompanying drawings.

Figure 1:
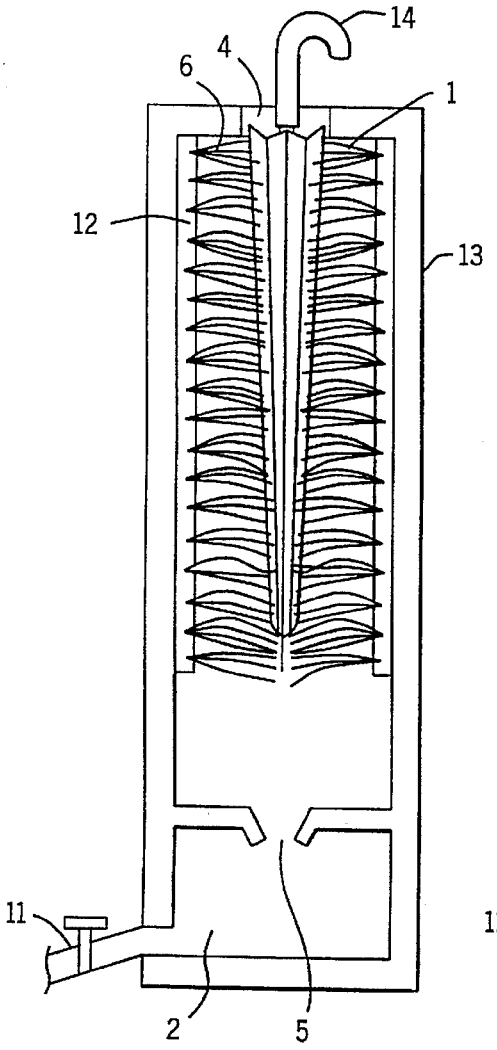
FIG. 1 is a cross sectional view of a schematic arrangement of a first embodiment of the present invention.
Figure 2:
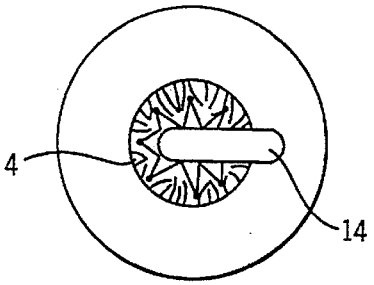
FIG. 2 is a top view of a schematic arrangement of the first embodiment of the present invention.

FIG. 1 is a cross sectional view showing a schematic diagram according to the first embodiment of the present invention, and FIG. 2 is a top view of the schematic arrangement.

Figure 3:
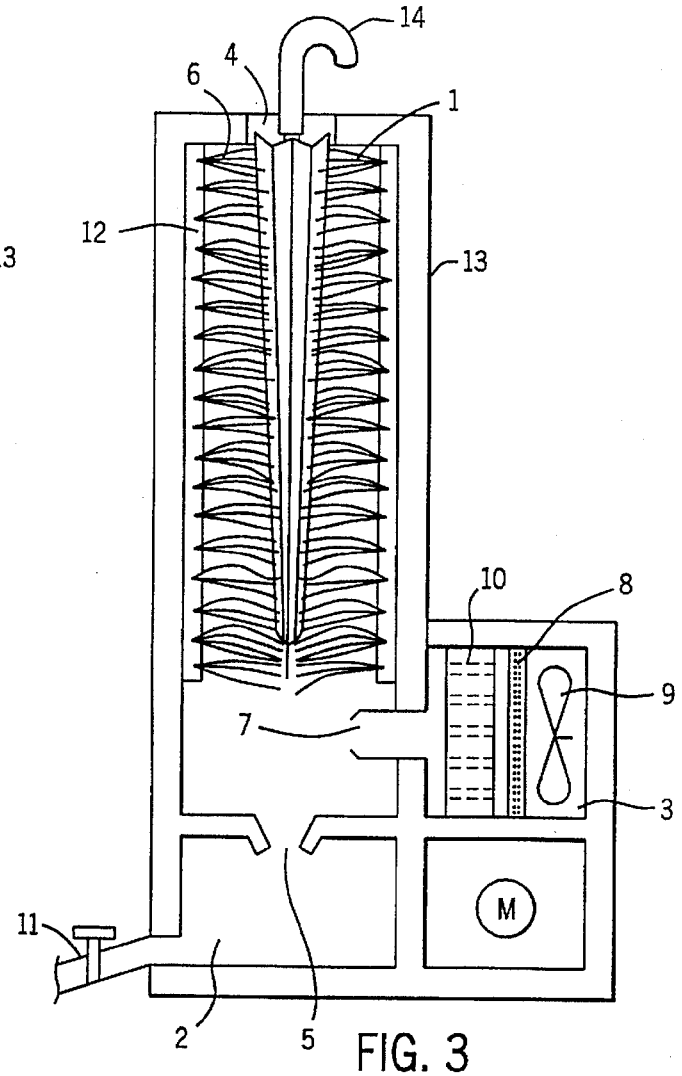
FIG. 3 is a cross sectional view of a schematic arrangement of a second embodiment of the present invention.
Figure 4:
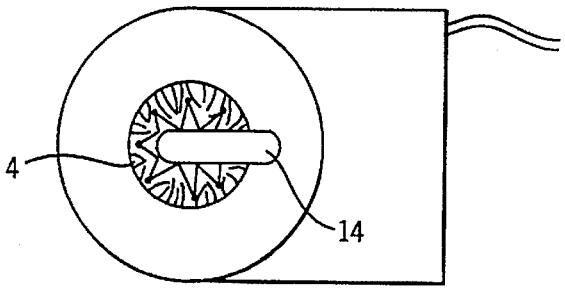
FIG. 4 is a top view of a schematic arrangement of the second embodiment of the present invention.

FIG. 3 is a cross sectional view showing a schematic diagram according to the second embodiment of the present invention, and FIG. 4 is a top view of the schematic arrangement.

Figure 5:
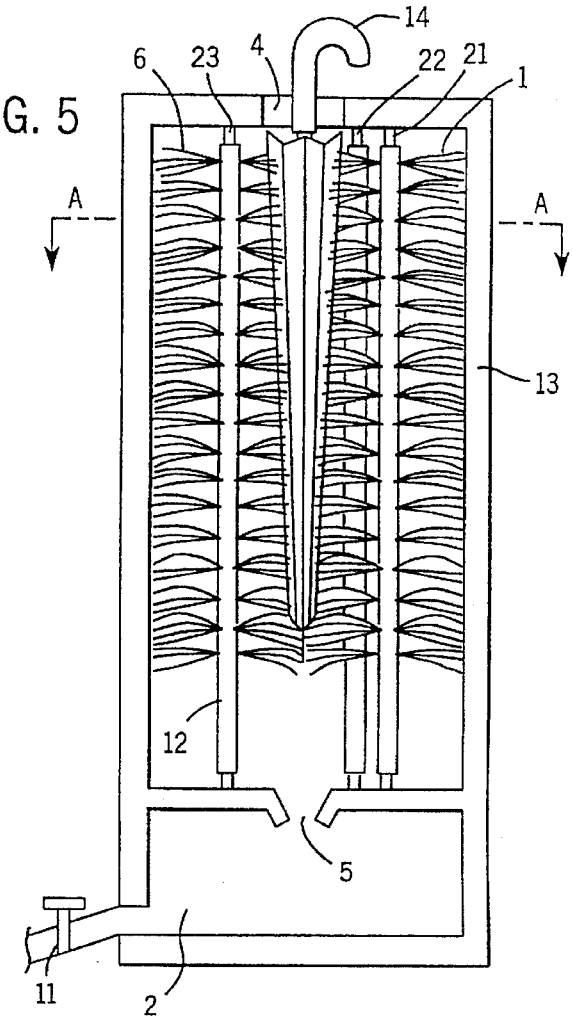
FIG. 5 is a cross sectional view of a schematic arrangement of a modification of the first embodiment of the present invention.
Figure 6:
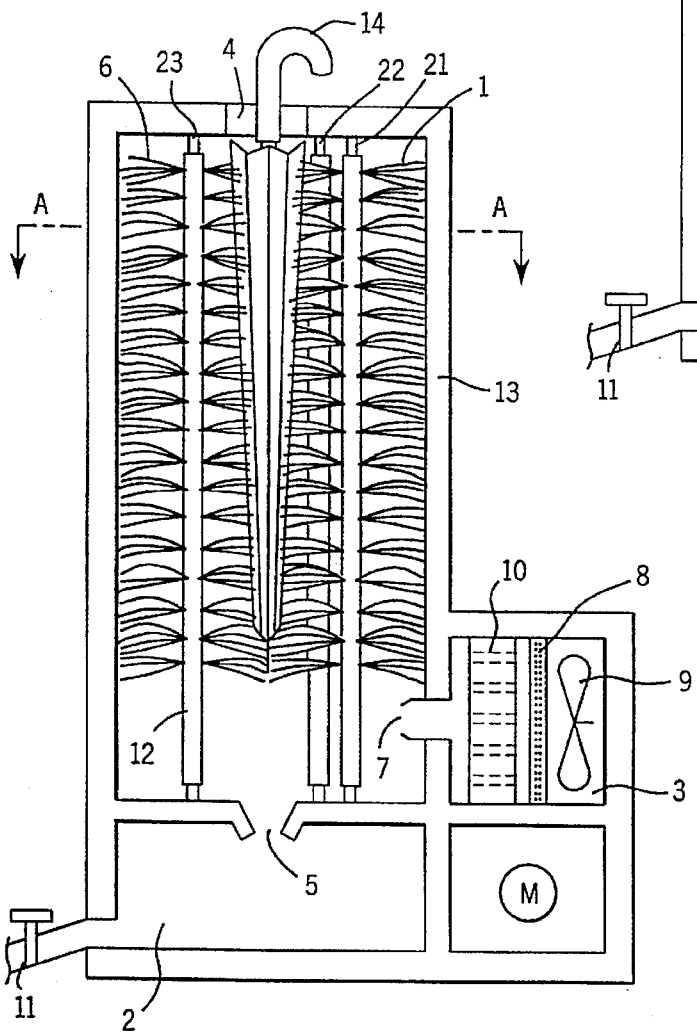
FIG. 6 is a cross sectional view of a schematic arrangement of a modification of the second embodiment of the present invention.
Figure 7:
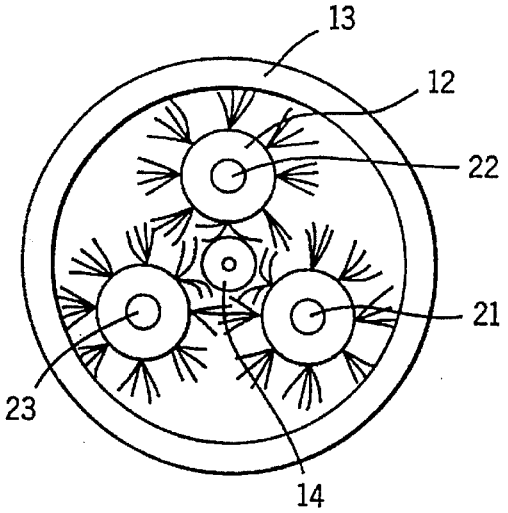
FIG. 7 is a cross sectional view along lines A—A of the modified first and second embodiments illustrated in FIGS. 5 and 6.
Figure 8:
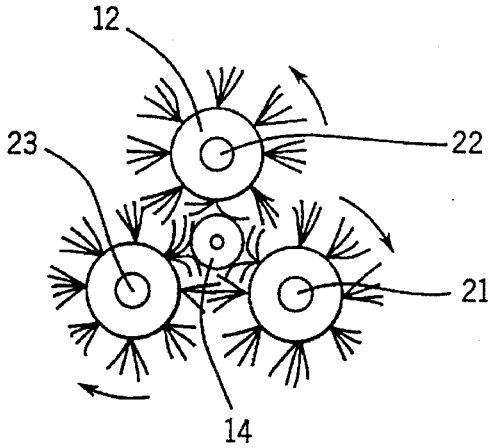
FIG. 8 is a diagram for explaining the rotation of the brush members.

FIG. 5 is a cross sectional view showing the schematic arrangement of a modification of the first embodiment, and FIG. 6 is a cross sectional view of the schematic arrangement of a modification of the second embodiment. FIG. 7 is a cross sectional view taken along lines A—A in FIGS. 5 and 6, and FIG. 8 is a diagram for explaining the rotation of brush members.

Figure 9:
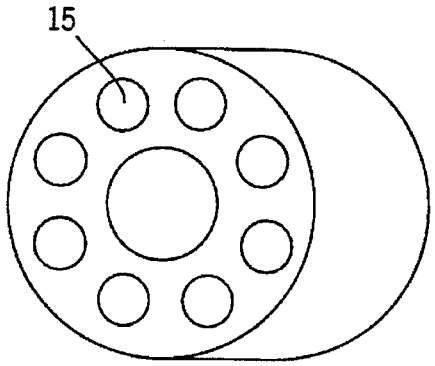
FIG. 9 is a perspective view showing an example arrangement of a ceramic body that is used in the second embodiment of the present invention.
Figure 10:
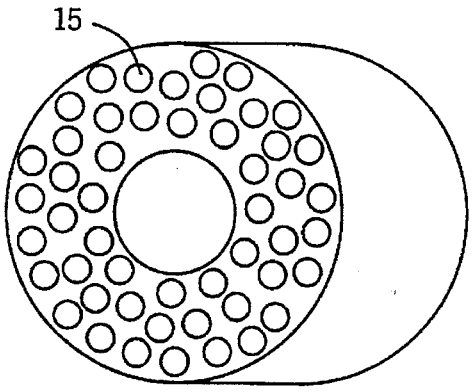
FIG. 10 is a perspective view showing another example arrangement of a ceramic body that is used in the second embodiment of the present invention.

FIG. 9 is a perspective view showing an example arrangement of a ceramic body that is employed in the second embodiment, and FIG. 10 is a perspective view showing another example arrangement of the ceramic body of the second embodiment.

Figure 11:
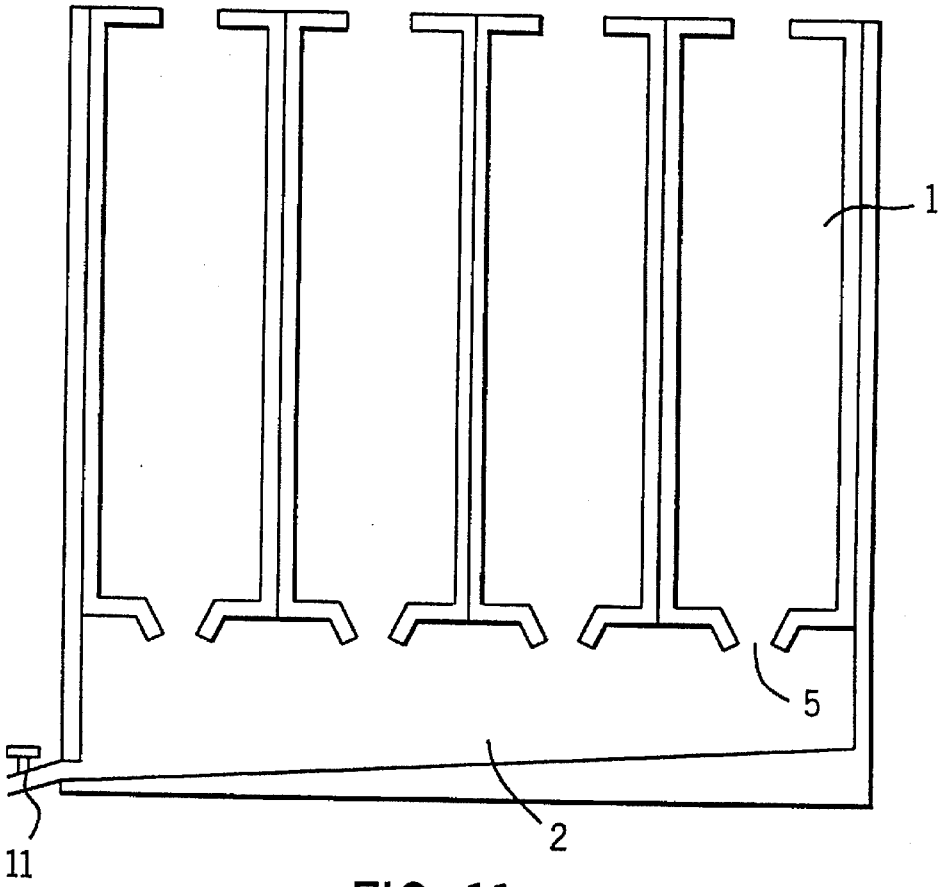
FIG. 11 is a cross sectional view for explaining a third embodiment of the present invention.
Figure 12:
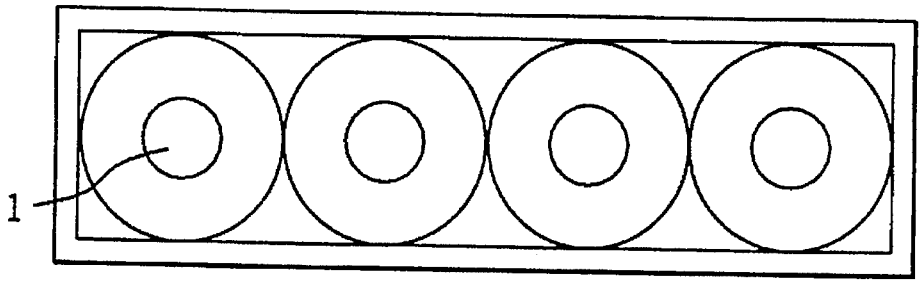
FIG. 12 is a top view for explaining the third embodiment of the present invention.

FIG. 11 is a cross sectional view for explaining the third embodiment, and FIG. 12 is a top view for explaining the third embodiment.

Figure 13:
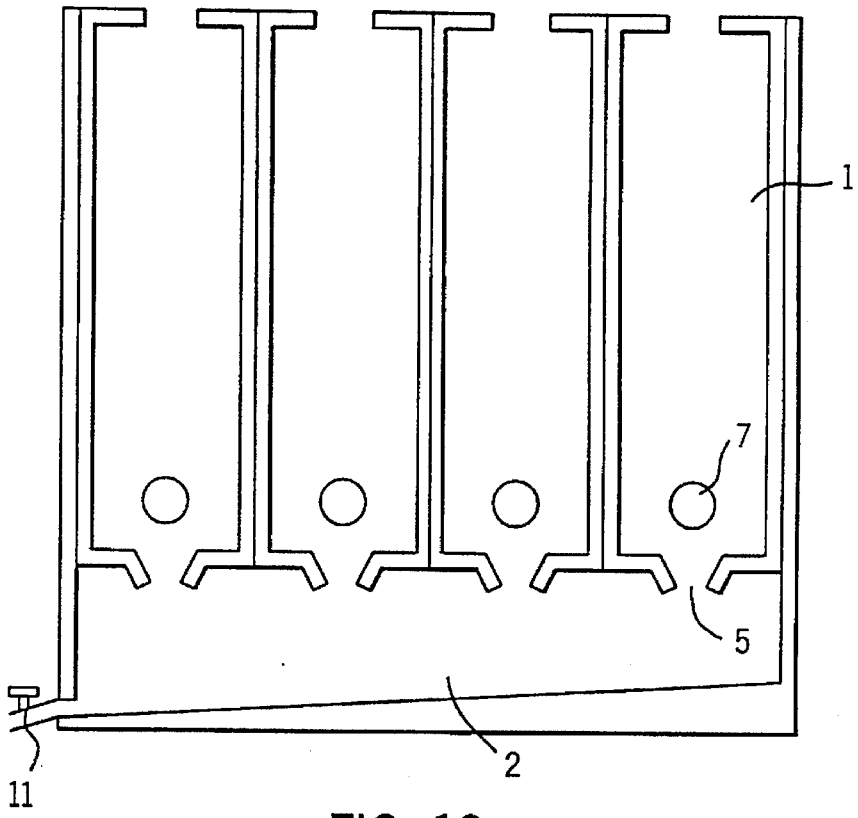
FIG. 13 is a cross sectional view for explaining a fourth embodiment of the present invention.
Figure 14:
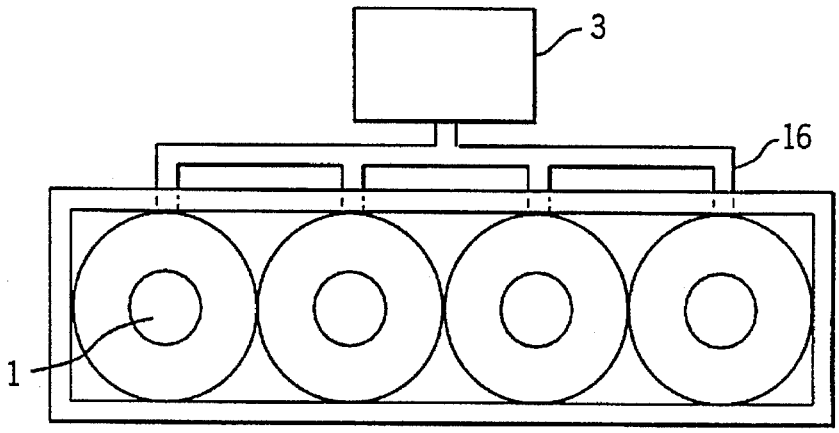
FIG. 14 is a top view for explaining the fourth embodiment of the present invention.

FIG. 13 is a cross sectional view for explaining the fourth embodiment, and FIG. 14 is a top view for explaining the fourth embodiment.

Figure 15:
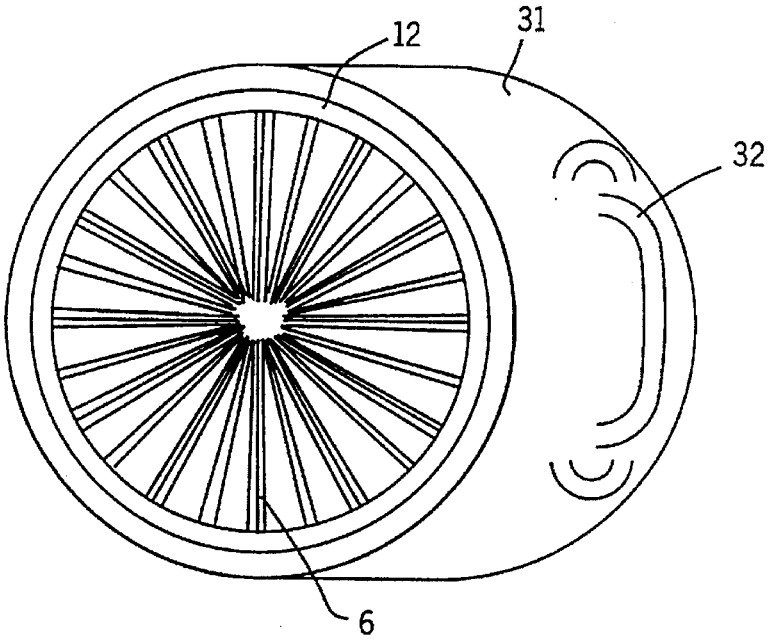
FIG. 15 is a perspective view of a schematic arrangement of a fifth embodiment of the present invention.
Figure 16:
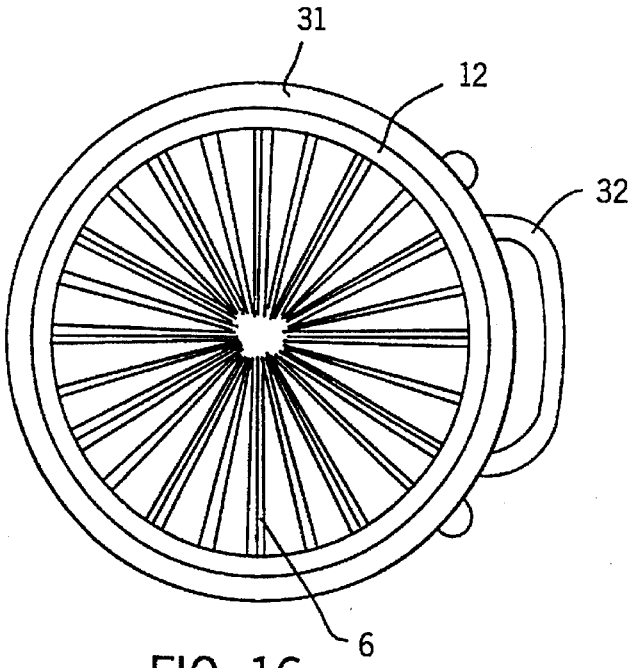
FIG. 16 is a front view of a schematic arrangement of the fifth embodiment of the present invention.
Figure 17:
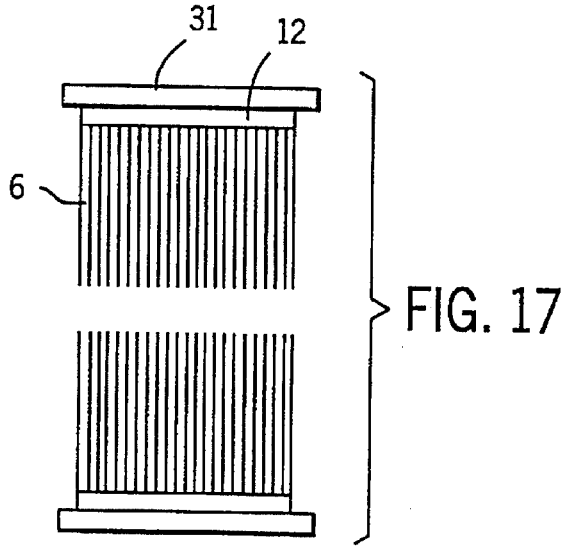
FIG. 17 is a cross sectional view of a schematic arrangement of the fifth embodiment of the present invention.
Figure 18:
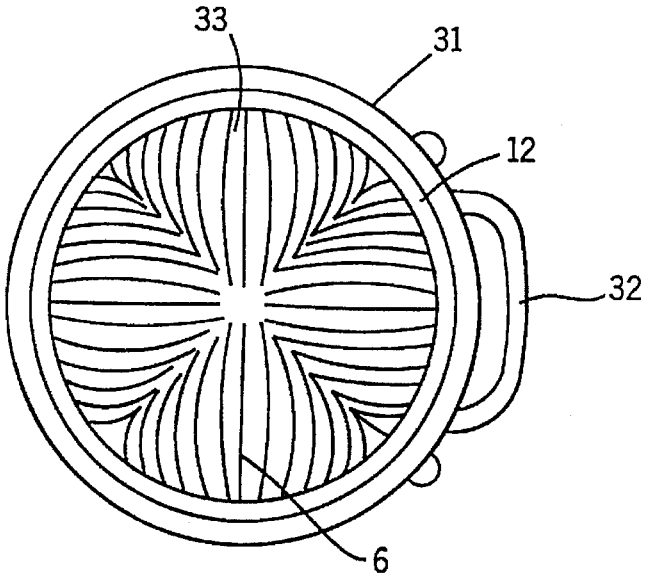
FIG. 18 is a front view of another example arrangement of the fifth embodiment of the present invention.

FIG. 15 is a perspective view illustrating a schematic arrangement according to the fifth embodiment, FIG. 16 is a front view of the schematic arrangement, FIG. 17 is a cross sectional view of the schematic arrangement, and FIG. 18 is a front view for explaining a modification of the fifth embodiment.

The same reference numbers are used to denote identical or corresponding components throughout the drawings.

In FIGS. 1 through 14, reference number 1 denotes an umbrella insertion portion into which an umbrella is inserted; 2, a rainwater collecting portion; 3, a fan compartment from which warm air is driven to the umbrella insertion portion 1; 4, an umbrella insertion port; 5, a first rainwater drain port; 6, brushes; 7, a warm air outlet; 8, a heater; 9, a fan; 10, an alkaline ceramic body; 11, a second rainwater drain tap; 12, a brush mounting member; 13, an external unit frame; 14, an umbrella; 15, a through hole that is formed in the alkaline ceramic body 10; 16, a hose; 21, a first brush member; 22, a second brush member; and 23, a third brush member.

As is shown in FIGS. 1 and 2, the unit in the first embodiment, which is cylindrical, comprises an umbrella insertion portion 1 that has an umbrella insertion port 4 formed at its top, a first rainwater drain port 5 formed at its bottom, and multiple brushes 6 on its internal wall and into which a rain dampened umbrella is inserted; and a rainwater collecting portion 2, for collecting and draining water, that has formed at its bottom a second rainwater drain tap 11, which can be closed and opened as necessary.

The diameter of the umbrella insertion port 4 should be large enough to insert an average size umbrella, preferably about 15 cm. The desired umbrella insertion portion 1 has a diameter of only about 20 cm to save on the space required for the installation of the unit.

The preferable brushes 6 are made of multiple plastic or fiber filaments, or animal hairs, and are sufficiently stiff to slip into the folds in the umbrella canopy.

The brushes 6 that are provided on the internal wall of the umbrella insertion portion 1 extend inward to near the center of the umbrella insertion portion 1, so that they can contact an umbrella that is inserted into the umbrella insertion portion 1. The brushes 6 are so positioned that, except for the handle, they can contact all of an umbrella that is inserted into the umbrella insertion portion 1.

Although the brushes 6 can be provided with their ends embedded directly in the external frame 13 of the unit, more preferably, the brushes 6 are held in the brush mounting member 12, which is then attached to the internal wall of the external frame 13. Brush mounting is thus easier.

The unit for removing rainwater from umbrellas in a modification of the first embodiment, as is shown in FIGS. 5 and 7, is cylindrical and comprises: an umbrella insertion port 4 formed at the top; a first rainwater drain port 5 formed at the bottom; and first, second, and third brush members 21, 22, and 23 that hold multiple brushes 6 and that are provided in an umbrella insertion portion 1.

The brushes 6 provided in the first, second, and third brush members 21, 22, and 23 are made of plastic or fiber filaments, or animal hair, and extend inward to near the center of the umbrella insertion portion 1, so that they can contact an umbrella that is inserted into the umbrella insertion portion 1. The brushes 6 are so positioned on the brush members that, except for the handle, they can contact all of an umbrella that is inserted into the umbrella insertion portion 1.

The brushes 6 may be provided with their ends directly embedded in the first, second, and third brush members 21, 22, and 23, but, more preferably, the brushes 6 are arranged with their ends embedded in brush mounting members 12, which are then attached to the external walls of the first, second, third brush members 21, 22, and 23, respectively.

With the above described arrangement, a closed umbrella 14 that is wet with rain is inserted through the umbrella insertion port 4 into the center of the umbrella insertion portion 1, where the multiple brushes 6 are disposed. As the umbrella 14 is inserted, the brushes 6 slip into the folds in the umbrella and are brought forcibly into contact with all of the folded canopy material. While the brushes 6 are in contact with the canopy material, they absorb and remove rainwater from the umbrella 14.

When the umbrella 14 is extracted from the umbrella insertion portion 1, the multiple brushes 6 are brought forcibly into contact with all of the canopy material along the folds of the umbrella 14 in the same manner as when the umbrella 14 was inserted. At this time, any residual rainwater is absorbed by the brushes 6. When the umbrella 14 has been extracted from the unit, all rainwater has been removed from it.

Further, as is shown in FIGS. 8, each time an umbrella 14 is inserted or extracted via the umbrella insertion port 4, the first, second, and third brush members 21, 22, and 23, which are controlled by a sensor (not shown), are rotated a quarter or a half turn.

More specifically, while an umbrella 14 is inserted into, or extracted from, the umbrella insertion portion 1, the first, second, and third brush members 21, 22, and 23 rotate, and the brushes 6 that have not absorbed rainwater are shifted inward so that they contact the next umbrella 14 that is inserted. By repeating the rotations, the brushes 6 that have not absorbed water are positioned to remove rainwater from an umbrella 14 that is newly inserted into the unit. In this case, as the brush members 21, 22, and 23 vibrate while they rotate, water on the brushes 6 is automatically removed and drains off through the first rainwater drain port 5.

In addition, each time an umbrella 14 is inserted or extracted through the umbrella insertion port 4, the first, second, and third brush members 21, 22, and 23, under the control of a sensor (not shown), vibrate up and down or from side to side. With this arrangement, the rainwater that is held by the brushes 6 can be disposed of and the process can be completely performed for the next umbrella.

Although in this embodiment three brush members are employed in the umbrella insertion portion 1, the number of brush members is not limited to three and can be altered as needed, depending on the number of umbrellas to be processed and the frequency at which the process is performed. Further, although the brush members are rotated a quarter or a half turn, the distance the brush members are rotated can be altered to ⅓ or ⅕ turn, depending on the size of the unit.

In the above described structure, water released from the brushes 6 passes through the first rainwater drain port 5 and is automatically collected in the rainwater collecting portion 2.

In addition to the unit explained in the first embodiment, as is shown in FIGS. 3, 4, 6, and 7, the unit of the second embodiment comprises: a warm air outlet 7, which is formed on the side of the umbrella insertion portion 1; and a fan compartment 3, from which warm air is driven into the umbrella insertion portion 1 and wherein a heater 8, a fan 9 and an alkaline ceramic body 10 are internally provided with the alkaline ceramic body 10 being located between the warm air outlet 7 and the heater The components of the fan compartment 3 can be controlled by a timer (not shown) that initiates, or halts, the expulsion of air when an umbrella 14 is inserted into, or extracted from, the umbrella insertion portion 1.

Air that is heated by the heater 8 and is driven by the fan 9 is passed through the alkaline ceramic body 10, which is located between the outlet 7 and the heater 8, to produce an alkaline air stream. The alkaline air stream accelerates the drying process.

The preferable temperature of heated air is about 20° to 40° C., or more preferably, about 25° to 35° C.

The alkaline air is driven into the umbrella insertion portion 1 to dry the rainwater absorbing brushes 6 and to evaporate water in the umbrella insertion portion 1. Drying the brushes 6 makes possible the complete removal of rainwater from an umbrella 14 that is inserted into the umbrella insertion portion 1.

The ceramic body 10 has a columnar shape and has a plurality of longitudinal through holes 15 in its cross section, as is shown in FIGS. 9 and 10. For good ventilation, it is desirable that multiple through holes 15 be provided. Although the examples shown in FIGS. 9 and 10 have cylindrical shapes, the shape of the ceramic body 10 is not thus limited and can be square or hexagonal.

As is shown in the cross sectional view in FIG. 9, the ceramic body 10 can be so designed that a large diameter through hole 15 is formed in its center and multiple through holes 15 that have rather small diameters are formed around it.

Further when, as is shown in the cross sectional view in FIG. 10, a through hole 15 that has a large diameter is formed in the center of the ceramic body 10 and multiple through holes 15 that have smaller diameters are formed around it, the alkaline gas content of the air that passes through these holes is increased and the drying of the brushes 6 is thereby improved.

The ceramic body 10 is preferably removable from the fan compartment 3, and a cartridge type, for example, should be employed. In this case, after a certain period of time has elapsed, the ceramic body 10 is replaced with a new one.

An appropriate ceramic is normally an alkaline ceramic that contains at least one element that is selected from a group consisting of, for example, powdered animal bone, powdered shell, powdered limestone, and powdered silica.

Another appropriate ceramic contains at least one ceramic material that is selected from a group consisting of silica gel, alumina, and zeolite.

Taking the occurrence of an alkaline air stream into account, a ceramic that contains powdered animal bone is desirable; moreover, a ceramic wherein the proportion of powdered animal bones is high, for example, 50 to 70 weight %, is more desirable.

The powdered animal bone can be replaced with another alkaline adsorbent that has a high alkaline solution absorption capability.

An additional agent, such as a binder or a filling agent, is added to these ceramics, as necessary, to form a ceramic body employed in the present invention.

The powdered animal bones described above are mainly those that are acquired by processing crude bones, especially the bones of cows, horses, and sheep that are commonly disposed of on farms, etc. The crude bones are cut into an appropriate size for a calcination process, boiled, and calcined at around 900° C. to 1100° C. Since oxidized putrefaction occurs on bones if organic substances that are not components of bone, such as gelatin, fat, protein, and glue, remain, such substances must be completely eliminated.

During the boiling process, most organic substances that are attached not only to the external walls of bones but are also inside the pores along the surface of bones can be removed. When the calcination process is then performed, the remaining organic substances can be removed completely, and simultaneously the humidity (water content) of the bone can be reduced to several percent or less, preferably to almost 0%.

Dependent on the calcining conditions, the bone is dried and maintains its original organization that includes multiple fine pores. After the bone is cooled, it is crushed, and then pulverized and formed into a bone powder having a size of about 20 to 200 mesh, more preferably 50 to 100 mesh, by a powdering machine.

The powdered bone has a yield of about 40 weight % of the original crude bone. The composition of the particles includes calcium (about 33 weight %) as a main component, phosphorus (about 16.7 weight %), barium (about 1.03 weight %), sodium (about 0.76 weight %), sulfur (about 0.64 weight %), and some magnesium, potassium, chlorine, amine, iron, and others. Multiple micropores communicate with each other both on the internal and external sides of the particles, which are alkaline.

Bentonite, Japanese acid clay, activated clay, kaolin clay, sericite, pyrophyllite, refractory clay, montmorillonite, or the like may be employed as a binder.

The rainwater collecting portion 2 collects rainwater that descends through the first drain port 5 and discharges it from the second rainwater drain tap 11, as necessary, as is shown in FIGS. 1, 3, 5, 6, 11, and 13. A water gauge (not shown) is installed on the rainwater collecting portion 2.

The rainwater collecting portion 2 can hold a specific amount of water. When the drying process is performed for only a few umbrellas, the second drain tap 11 is closed and the water is retained. Then, when the rainwater collecting portion 2 has been filled with water, the rainwater drain tap 11 is opened and the water is discharged. In this manner, a large space is not required for the installation of this unit.

When many umbrellas must be processed by a unit of the present invention, a separately provided water storage tank can be employed that communicates directly with the second rainwater drain tap 11 for automatic water discharge.

As is shown in FIGS. 11 and 12, the unit for removing rainwater from umbrellas for the third embodiment comprises an in-line arranged plurality of the umbrella insertion portions 1 that are employed for the first or second embodiment, and a rainwater collecting portion 2 below the umbrella insertion portions 1.

Rainwater from the umbrella insertion portions 1 descends through water drain ports 5 that are formed at the bottoms of the respective umbrella insertion portions 1 and is collected in, and discharged from, the rainwater collecting portion 2.

The unit for removing rainwater from umbrellas of the fourth embodiment, as is shown in FIGS. 13 and 14, comprises: an in-line arranged plurality of the umbrella insertion portions 1 that are employed for the first or second embodiment; a rainwater collecting portion 2, which is provided below the umbrella insertion portions 1; and a fan compartment 3, from which warm air is driven through individual outlets 7 into the umbrella insertion portions 1.

Multiple brushes 6 that are arranged on the internal wall of the umbrella insertion portions 1, and the individual umbrella insertion portions 1, are dried by warm air that is driven from the fan compartment 3 through a hose 16 and enters the umbrella insertion portions 1 via the respective outlets 7.

The rainwater collecting portion 2 can hold a specific volume of water. When the drying process is performed for only a few umbrellas, a second drain tap 11 is closed and water is retained. Then, when the rainwater collecting portion 2 has been filled with water, the rainwater drain tap 11 is opened and the water is discharged. In this manner, a large space is not required for the installation of this unit.

When many umbrellas must be processed by the unit of the present invention, a separately provided water storage tank can be employed that communicates directly with the second rainwater drain tap 11 for automatic water discharge. It is preferable that the bottom of the rainwater collecting portion 2 be tilted to ensure a smooth discharge.

Although this embodiment provides for an incline arrangement of only four umbrella insertion portions 1, configurations are possible in which the number of umbrella insertion portions 1 is governed by the desired unit size and the number of umbrellas for which simultaneous processing is required. In this instance, the umbrella insertion portions 1 that are required can be arranged in arbitrary numbers of rows or columns.

A unit of this invention that is configured as is described above can satisfactorily meet the requirements for supermarkets and government offices, or for ticket gates in subway stations, etc., where there are many transients, for the simultaneous processing of multiple wet umbrellas.

The unit for removing rainwater from umbrellas of the fifth embodiment, as is shown in FIGS. 15 through 18, comprises a cylindrical external frame 31 with a handle 32, and multiple brushes 6 that are provided on the internal wall of the external frame 31.

In FIGS. 15 through 18, reference number 31 denotes the external frame of the unit; 32, the handle; 33, a plurality of brush groups that are tapered toward the center; 6, the brushes; and 12, a brush mounting member.

The external frame 31, which has a cylindrical shape and is open at both ends, is made of wood, metal, plastic, etc. The external frame 31 also has the handle 32 to facilitate the insertion of the umbrella into and its extraction from the unit.

It is preferable that the handle 32 have portions that are held with a thumb and a little finger and a portion between them that is held with a middle finger, etc. Such a configuration will make it easy for an umbrella to be inserted into, or extracted from, the thus structured unit.

The diameter of the external frame 31 is large enough for an average size umbrella to pass through, and is preferably about 10 cm to 15 cm. For the unit to be portable, the preferable length of the external frame 31 is about 5 to 7 cm.

Although in this embodiment the external frame 31 has a circular cross section, the cross section of the external frame 31 is not thus limited, and can be, for example, square or hexagonal.

The brushes 6, which can be made of plastic or fiber, or animal hair, extend inward to near the center so that they can contact all of an umbrella that is inserted into the unit. It is desirable that multiple brushes 6 be provided to completely absorb rainwater from the umbrella.

Further, as is shown in FIG. 18, the lengths of the brushes 6 of the brush groups 33 are adjusted so that the brush groups 33 are tapered toward the center. A plurality of the brush groups 33 are provided inside the external frame 31. Multiple brushes 6 with different lengths are therefore provided in the external frame 31.

With this arrangement, the brushes 6 easily contact all of the canopy material of the folded umbrella. In other words, as the short brushes can slip into the folded portions that the long brushes cannot, complete absorption of rainwater from the umbrella is ensured.

Although in this embodiment four of the brush groups 33 that are tapered toward the center are arranged inside the external frame 31, the number of the brush groups 33 is optional and is not limited to four.

The multiple brushes 6 may be installed with their ends directly embedded in the external frame 31, but, more preferably, the brushes 6 are held by the brush mounting member 12, which is then attached to the internal wall of the external frame 31.

With the above described structure, a closed umbrella that is wet with rainwater is inserted through the multiple brushes 6 that are arranged in the unit. As the umbrella is inserted, the brushes 6 that come into contact with the canopy material of the umbrella slip into its folded portions. While the multiple brushes 6 are then guided by the folds in the canopy material, they are held forcibly against the canopy material of the umbrella so that they contact all of its surface and absorb the rainwater thereon.

Likewise, while the umbrella is being extracted from the unit, the canopy material of the umbrella is forcibly brought into contact with the multiple brushes 6, as they are guided by the folds in the canopy material, and they absorb any residual rainwater. When the umbrella has been fully removed from the unit, all rainwater has been removed from it.

The unit of this invention can be employed as a portable means to remove rainwater from umbrellas. As it can be stored in a separate container made of plastic, etc., it can be carried in a handbag, or other receptacle, so that it is available for use before boarding a train or a bus, or before entering a private home or a hotel.

By carrying the unit of the present invention on rainy days and using it before boarding a vehicle or entering a private home, it is possible to avoid discomforting other vehicle passengers, by leaking water on them or on articles they are carrying, and to avoid inconveniencing other guests who are visiting a home, and the host or hostess, by forgetting an umbrella or by picking up the wrong one when departing.

As the unit for removing rainwater from umbrella according to the present invention can easily, effectively, and quickly remove rainwater from umbrellas, on rainy days it can eliminate the problems that arise when guests forget their umbrellas, or pick up the wrong ones, and can provide better service for visitors.

When this unit is installed near ticket gates in subway stations, etc., so that passengers may process their umbrellas that are wet with rain before they board vehicles, the dampening of passengers clothing on such vehicles as trains and buses can be prevented.

By having the unit of the present invention available for use on rainy days, it is possible to eliminate such sources of discomfort for vehicle passengers as those that are caused by leaking water, and such sources of inconvenience for guests at a home as the forgetting of umbrellas or the picking up of the wrong ones.

Various modes of carrying out the invention are contemplated as being within the scope of the following claims that in particular point out and distinctly describe the subject matter that is regarded as the invention.

What is claimed is:

1. A unit, for removing rainwater from umbrellas, comprising:

cylindrical umbrella insertion portion into which an Umbrella wet with rainwater is inserted, said umbrella insertion portion having a top, a bottom, and an internal wall;

an umbrella insertion port formed in the top of said umbrella insertion portion;

a first rainwater drain port in the bottom of said umbrella insertion portion;

multiple brushes provided on the internal wall of said umbrella insertion portion;

a rainwater collecting portion in which the rainwater from umbrellas is held and from which the held rainwater is discharged; and a fan compartment from which warm air is driven into said umbrella insertion portion.

2. A unit, for removing rainwater from umbrellas, according to claim 1, wherein said multiple brushes provided in said umbrella insertion portion are made of one of plastic, fiber, or and animal hair, and extend inward to near the center of said umbrella insertion portion.

3. A unit, for removing rainwater from umbrellas, according to claim 1, wherein said multiple brushes provided in said umbrella insertion portion are embedded in a brush mounting member, which is attached to the internal wall of said umbrella insertion portion.

4. A unit, for removing rainwater from umbrellas, according to claim 1, wherein said umbrella insertion portion has a plurality of brush members bearing said multiple brushes.

5. A unit, for removing rainwater from umbrellas, according to claim 4, wherein said plurality of brush members are a first, a second, and a third brush member.

6. A unit, for removing rainwater from umbrellas, according to claim 4, wherein said multiple brushes provided for said brush members are made of one of plastic, fiber, and animal hair, and extend inward to near the center of said umbrella insertion portion.

7. A unit, for removing rainwater from umbrellas, according to claim 6, wherein said multiple brushes provided for said plurality of brush members are embedded in brush mounting members, which are attached to said brush members.

8. A unit, for removing rainwater from umbrellas, according to claim 1, wherein said fan compartment is positioned adjacent to a warm air outlet that is formed in the side of said umbrella insertion portion, and has mounted internally a heater, a fan, and an alkaline ceramic body located between said heater and said warm air outlet.

9. A unit, for removing rainwater from umbrellas, according to claim 1, wherein the temperature of the warm air that is driven from said fan compartment into said umbrella insertion portion is about 20° C. to 40° C.

10. A unit, for removing rainwater from umbrellas, according to claim 1, wherein said rainwater collecting portion has at the bottom a second rainwater drain tap that is opened and closed as necessary.

11. A unit, for removing rainwater from umbrellas, according to claim 8, wherein said alkaline ceramic body contains at least one element that is selected from a group consisting of powdered animal bone, powdered shells, powdered limestone, silica, and powdered coral.

12. A unit, for removing rainwater from umbrellas, according to claim 8, wherein said alkaline ceramic body has a columnar shape and a plurality of longitudinal through holes, such that said longitudinal through holes allow air to pass through said ceramic body.

13. A unit, for removing rainwater from umbrellas, according to claim 1, wherein a plurality of said umbrella insertion portions are arranged in line and said rainwater collecting portion is located below said umbrella insertion portions.

14. A unit, for removing rainwater from umbrellas, according to claim 1, wherein a plurality of said umbrella insertion portions are arranged in line, said rainwater collecting portion is located below said umbrella insertion portions, and said fan compartment is so provided that warm air is driven through warm air outlets formed in said umbrella insertion portions and into said umbrella insertion portions.

15. A unit, for removing rainwater from umbrellas, according to claim 6, wherein a plurality of said umbrella insertion portions are arranged in line and said rainwater collecting portion is located below said umbrella insertion portions.

16. A unit, for removing rainwater from umbrellas, according to claim 4, wherein a plurality of said umbrella insertion portions are arranged in line, said rainwater collecting portion is located below said umbrella insertion portions, and said fan compartment is so provided that warm air is driven through warm air outlets formed in said umbrella insertion portions and into said umbrella insertion portions.

17. A unit, for removing rainwater from umbrellas, comprising:

a cylindrical umbrella insertion portion into which an umbrella wet with rainwater is inserted, said umbrella insertion portion having a top, a bottom, and an internal wall;

an umbrella insertion port formed in the top of said umbrella insertion portion;

a first rainwater drain port in the bottom of said umbrella insertion portion;

multiple brushes provided on the internal wall of said umbrella insertion portion;

a rainwater collecting portion in which the rainwater from the umbrella is held and from which the held rainwater is discharged; and a fan compartment positioned adjacent to a warm air outlet that is formed in said umbrella insertion portion;

said fan compartment having an internally mounted heater, a fan, and an alkaline ceramic body located between said heater and said warm air outlet, such that said heater, said fan, and said alkaline ceramic body drive alkali warm air into said umbrella insertion portion to accelerate the drying of said umbrellas and said umbrella insertion portion.

18. A unit, for removing rainwater from umbrellas, according to claim 17, wherein said alkaline ceramic body contains at least one element that is selected from a group consisting of powdered animal bone, powdered shells, powdered limestone, silica, and powdered coral.

* * * * *